US011242854B2

(12) United States Patent
Kim et al.

(10) Patent No.: US 11,242,854 B2
(45) Date of Patent: Feb. 8, 2022

(54) SCROLL COMPRESSOR

(71) Applicant: LG ELECTRONICS INC., Seoul (KR)

(72) Inventors: Suchul Kim, Seoul (KR); Changeol Jo, Seoul (KR); Donghyun Sohn, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 23 days.

(21) Appl. No.: 16/929,518

(22) Filed: Jul. 15, 2020

(65) Prior Publication Data

US 2021/0017985 A1 Jan. 21, 2021

(30) Foreign Application Priority Data

Jul. 17, 2019 (KR) ..... 10-2019-0086564

(51) Int. Cl.

| | |
|---|---|
| ***F04C 18/02*** | (2006.01) |
| ***F04C 23/00*** | (2006.01) |
| ***F04C 27/00*** | (2006.01) |
| ***F04C 29/00*** | (2006.01) |

(52) U.S. Cl.

CPC ..... *F04C 18/0215* (2013.01); *F04C 23/008* (2013.01); *F04C 18/0261* (2013.01); *F04C 27/005* (2013.01); *F04C 2240/30* (2013.01); *F04C 2240/603* (2013.01)

(58) Field of Classification Search

CPC ..... F04C 18/0215; F04C 18/0261; F04C 23/008; F04C 23/02; F04C 27/005; F04C 29/0021; F04C 29/00; F04C 29/0057; F04C 2240/603; F04C 2240/30; F04C 2240/10; F04C 2240/805; F05B 2210/14; F05B 2260/301

See application file for complete search history.

(56) References Cited

U.S. PATENT DOCUMENTS

| | | | | |
|---|---|---|---|---|
| 11,053,941 | B2 * | 7/2021 | Park | F04C 18/0215 |
| 2013/0089449 | A1 * | 4/2013 | Seong | F04C 28/06 418/55.2 |
| 2013/0121864 | A1 * | 5/2013 | Jang | F04C 27/005 418/55.1 |

FOREIGN PATENT DOCUMENTS

| | | |
|---|---|---|
| KR | 10-1998-0050613 | 9/1998 |
| KR | 10-2013-0034529 | 4/2013 |
| KR | 10-2018-0065340 | 6/2018 |

OTHER PUBLICATIONS

Korean Office Action dated Sep. 16, 2020.

* cited by examiner

*Primary Examiner* — Audrey B. Walter
*Assistant Examiner* — Dapinder Singh
(74) *Attorney, Agent, or Firm* — Ked & Associates LLP

(57) ABSTRACT

A scroll compressor is provided in which a center of a back pressure chamber is eccentrically disposed relative to a center of a fixed scroll. For example, the center of the back pressure chamber may be moved towards a center of an orbiting scroll at a time of discharge, thereby preventing displacement of the fixed scroll and ensuring stability in orbital movement of the orbiting scroll.

20 Claims, 12 Drawing Sheets

SCROLL COMPRESSOR

CROSS-REFERENCE TO RELATED APPLICATION(S)

This application claims priority to and the benefit of Korean Patent Application No. 10-2019-0086564, filed in Korea on Jul. 17, 2019, the disclosure of which is incorporated herein by reference in its entirety.

BACKGROUND

1. Field

A scroll compressor is disclosed herein.

2. Background

Compressors are devices for compressing fluids, such as refrigerant, for example. They may be classified as rotary compressors, reciprocating compressors, or scroll compressors, for example, based on methods of compressing fluids.

Scroll compressors are compressors that include two scrolls. The two scrolls (a fixed scroll and an orbiting scroll) include a wrap respectively. While the wraps make relative orbital movements, a plurality of compression chambers is formed between the scrolls. A volume of the compression chamber is reduced while the compression chamber continues to move in an approximately central direction from a suction port, into which refrigerants are suctioned, towards a discharge port, from which compressed refrigerants are discharged. Accordingly, refrigerants continue to be suctioned and compressed.

In this case, among the plurality of compression chambers, a compression chamber adjacent to the suction port into which refrigerant is suctioned has a minimum pressure, and a compression chamber communicating with the discharge port has a maximum pressure. A pressure of a compression chamber between the two compression chambers has an intermediate pressure having a value between values of a suction pressure of the suction port and a discharge pressure of the discharge port.

A scroll compressor of the related art includes a back pressure chamber where the intermediate pressure is applied to an end plate opposite to a plate where a wrap of a fixed scroll (or FS), or an orbiting scroll (or OS) is formed. The intermediate pressure presses the fixed scroll or the orbiting scroll including the back pressure chamber towards the orbiting scroll or the fixed scroll including no back pressure chamber. The back pressure chamber prevents widening of a gap between the fixed scroll and the orbiting scroll, which is caused by a compression pressure at the time of suction and compression of refrigerant, thereby causing no deterioration of efficiency in the compressor.

FIG. 1 is a perspective view illustrating a disposition relationship between a back pressure chamber and a fixed scroll in a scroll compressor of the related art. As illustrated in FIG. 1, centers of the back pressure chamber and the fixed scroll are disposed at a same axis in the scroll compressor of the related art. Their dispositions in FIG. 1 cause problems presented in FIG. 2.

FIGS. 2A-2B are schematic views illustrating movements of the fixed scroll, caused by a pressure of refrigerant in a compression chamber, when the fixed scroll and the orbiting scroll make relative orbital movements in the scroll compressor in FIG. 1. As illustrated in FIG. 2A, in the scroll compressor of the related art, the fixed scroll and the back pressure chamber are coupled at a same center. When operating, the orbiting scroll moves along an orbit radius.

In this case, a center of a compression chamber is disposed between centers of the fixed scroll and the orbiting scroll. When a compression force in the compression chamber increases, due to a reaction to the increase, a pressure from refrigerant gas (the so-called "gas force") increases.

In a case in which the gas force increases significantly, the fixed scroll receives a reaction force by the gas force. When the gas force moves the fixed scroll in a shaft or axial direction (a direction of a drive shaft) in the compression chamber, the fixed scroll moves in a direction opposite to the orbiting scroll. In this case, the center of the back pressure chamber is disposed to be aligned with the center of the fixed scroll. Accordingly, movement of the fixed scroll in the shaft direction, which is made due to a gas pressure of the fixed scroll, cannot be effectively suppressed.

As a result, in the back pressure structure of the scroll compressor of the related art, an unbalanced force in the shaft direction in the compression chamber may cause instability due to movement of the orbiting scroll. The instability in movement of the orbiting scroll results in a locally widening gap between the fixed scroll and the orbiting scroll in the shaft direction, and leakage of refrigerant. Thus, the scroll compressor of the related art may cause deterioration in compression efficiency.

Further, the instability in movement of the orbiting scroll facilitates friction between the fixed scroll and the orbiting scroll. Accordingly, the scroll compressor of the related art may cause deterioration in lifespan and reliability of the compressor as well as deterioration in compression efficiency.

In a case in which significant wear occurs due to friction between the orbiting scroll and the fixed scroll, fractures are produced due to the wear and remain in the compression chamber, thereby facilitating additional wear on the fixed scroll and the orbiting scroll as well as deterioration in compression efficiency. Finally, the compressor may be damaged.

BRIEF DESCRIPTION OF THE DRAWINGS

Embodiments will be described in detail with reference to the following drawings in which like reference numerals refer to like elements, and wherein.

DETAILED DESCRIPTION

Figure 1:
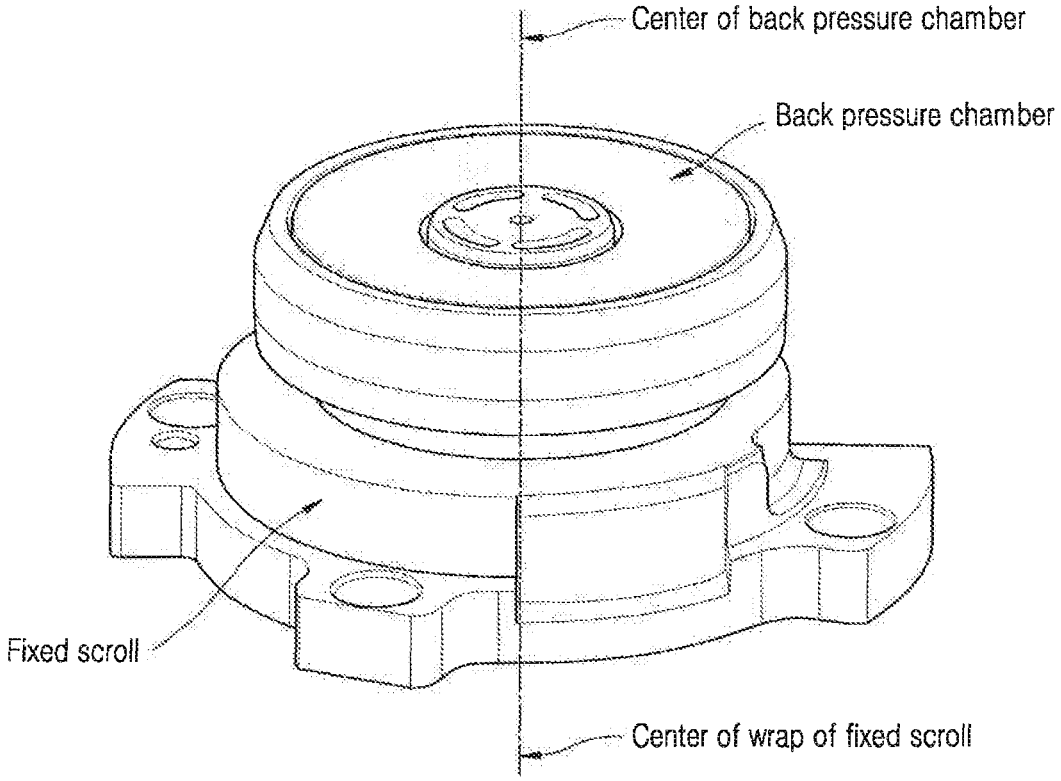
FIG. 1 RELATED ART
FIG. 1 is a perspective view illustrating a disposition relationship between a back pressure chamber and a fixed scroll in a scroll compressor of the related art.

Embodiments are described with reference to the accompanying drawings such that one having ordinary skill in the art to which the embodiments pertain may easily implement the technical spirit. In the description, detailed description of relevant technologies is omitted if it is deemed to make the gist unnecessarily vague. Embodiments are described with reference to the accompanying drawings. Throughout the drawings, identical or similar reference numerals denote identical or similar components.

When any component is described as being "at an upper portion (or a lower portion) of a component" or "on (or under)" a component, any component may be placed on the upper surface (or the lower surface) of the component, and an additional component may be interposed between the component and any component placed on (or under) the component. In describing components of the disclosure, when any one component is described as being "connected," "coupled" or "connected" to another component, any component may be directly connected or may be able to be directly connected to another component; however, it is also to be understood that an additional component may be "interposed" between the two components, or the two components may be "connected", "coupled" or "connected" through an additional component.

Below, embodiments of a scroll compressor are described with reference to the accompanying drawings. During description of the embodiments, a thickness of lines or size of elements, for example, illustrated in the drawings may be exaggerated for the sake of convenience and clarity in description. Further, terms that will be described hereunder are those defined considering functions described, and they may differ depending on the intention or the practice of the user or operator. Therefore, the terms should be defined on the basis of the details throughout the specification.

Figure 3:
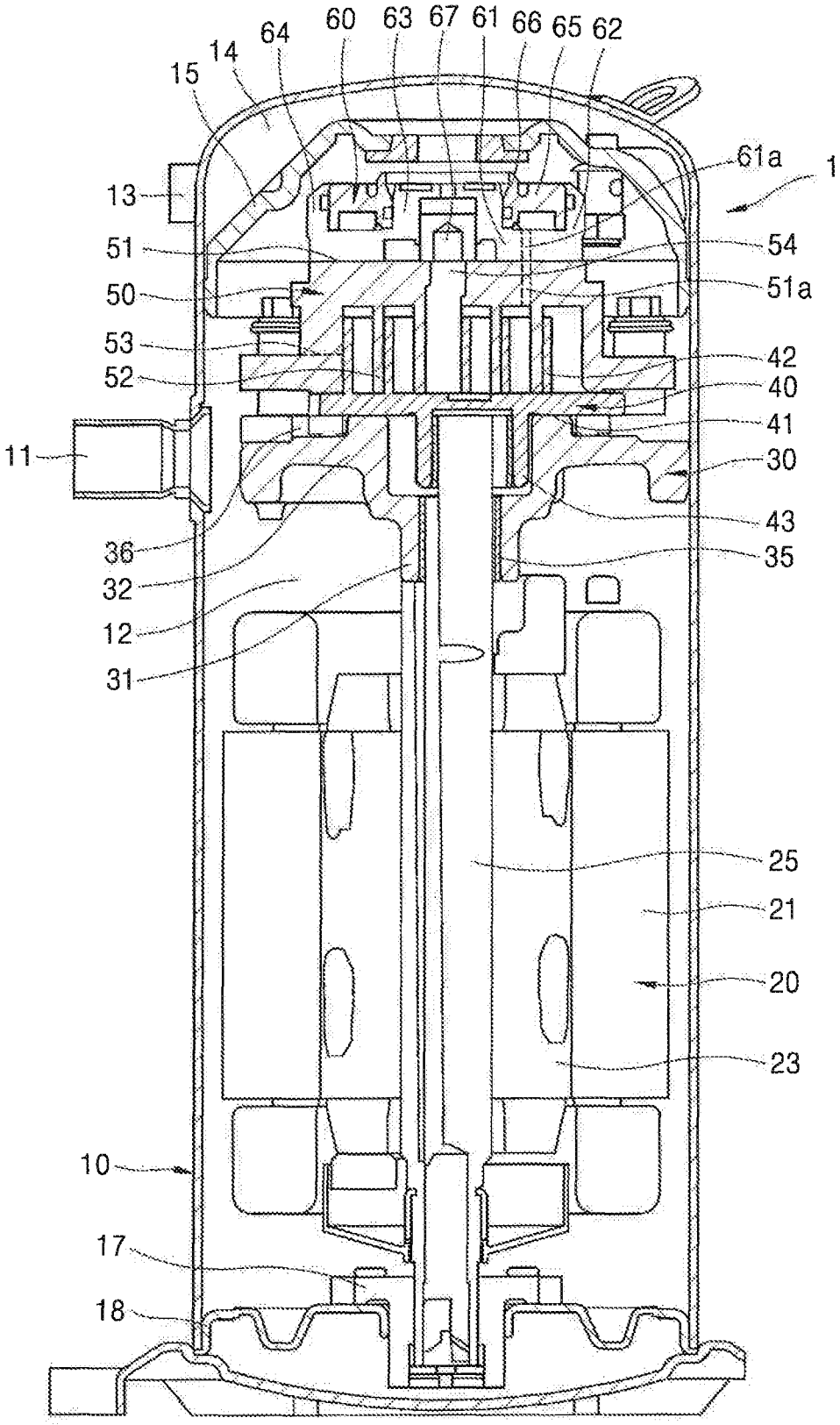
FIG. 3 is a longitudinal cross-sectional view of a scroll compressor according to an embodiment.

FIG. 3 is a longitudinal cross-sectional view schematically illustrating a scroll compressor according to an embodiment. Scroll compressor 1 according to an embodiment may include a casing 10, a motor 20, a drive shaft 25, an orbiting scroll 40, and a fixed scroll 50.

The casing 10 may form an appearance of the scroll compressor 1 according to the embodiment. In the casing 10, an inner space for accommodating various components of the scroll compressor 1 is formed. The casing 10 may have an approximately cylindrical shape.

The casing 10 may be provided with a suction port 11 and a discharge port 13. The suction port 11 may be a passage that is formed at the casing 10 to introduce refrigerant into the casing 10, and the discharge port 13 may be a passage formed at the casing 10 to discharge refrigerants, compressed in the casing 10, out of the casing 10.

The inner space of the casing 10 may be divided into a motor portion that is a space where the motor 20 is installed, and a compression portion that is a space where refrigerant is compressed. The motor 20 may be accommodated in the inner space of the casing 10, specifically, in a suction space 12, and more specifically, in the motor portion. The motor 20 may comprise a stator 21 and a rotor 23. Additionally, a constant-speed motor, in which a rotational speed of the rotor 23 is constant, may be used as the motor 20. An inverter motor, in which the rotational speed of the rotor 23 is variable, may also be used as the motor 20.

The stator 21 may be, for example, shrink-fitted onto an inner wall of the casing 10, and the drive shaft 25 may be inserted into and coupled to a central portion of the rotor 23. A coil may be wound around the stator 21, and though not illustrated in FIG. 3, the coil may be electrically connected with an external power supply through a terminal coupled to the casing 10.

The drive shaft 25 may be connected to the rotor 23 of the motor 20, and may be rotated by a rotational force generated by the motor 20. The drive shaft 25 may pass through a main frame 30, described hereinafter, and then may be coupled to the orbiting scroll 40. The orbiting scroll 40 may be coupled to the drive shaft 25 and may make an orbital movement.

A lower side of the drive shaft 25 may be rotatably supported by an auxiliary bearing 17 disposed at a lower portion of the casing 10. The auxiliary bearing 17 may be supported by a lower frame 18 fixed onto an inner surface of the casing 10 and may support the drive shaft 25 stably. The lower frame 18 may be, for example, welded and fixed onto the inner wall of the casing 10, and a bottom surface of the casing 10 may be used as an oil storage. Oil stored in the oil storage may be moved to an upper side of the casing 10 by the drive shaft 25, for example, and may be provided to the compression portion for lubrication.

An upper end of tile drive shaft 25 may be rotatably supported by the main frame 30. The main frame 30 may be disposed between the motor 20 and the orbiting scroll 40 while being installed in the inner space of the casing 10. The inner space of the casing 10 may be divided into the motor portion and the compression portion by the main frame 30.

Drive shaft supporters 31, 32, that support the drive shaft 25 passing through the main frame 30, may be disposed at a center of the main frame 30 in a diameter-wise or radial direction of the main frame 30. A main bearing 35, that supports the drive shaft 25 in the diameter-wise direction of the main frame 30, may be installed at the drive shaft supporters 31, 32.

Like the lower frame 18, the main frame 30 may be fixed and disposed onto the inner wall of the casing 10, and the main bearing 35 protruding downwards may be disposed on a lower surface of the main frame 30. The drive shaft 25 may be inserted into the main bearing 35. An inner wall of the main bearing 35 may function or operate as a bearing surface, and may support the drive shaft 25 along with the oil such that the drive shaft 25 smoothly rotates.

The orbiting scroll 40 may be disposed on an upper surface of the main frame 30. The orbiting scroll 40 may include an orbiting scroll end plate 41 having an approximately circular plate shape, and an orbiting wrap 42 formed on one surface of the orbiting scroll end plate 41 in a spiral shape. The orbiting wrap 42 may form a compression chamber along with fixed wrap 52 of the fixed scroll 50, described hereinafter.

The orbiting scroll end plate 41 may orbit in a state where the orbiting scroll end plate 41 is supported by the upper surface of the main frame 30. In this case, an Oldham ring 36 as a device for preventing self-rotation of the orbiting scroll 40 may be disposed between the orbiting scroll end plate 41 and the main frame 30.

A boss 43, into which the drive shaft 25 may be inserted, may be formed on a lower surface of the orbiting scroll end plate 41. Through the boss 43, the orbiting scroll 40 may orbit by a rotational force of the drive shaft 25.

The fixed scroll 50 may be disposed in the inner space of the casing 10, specifically, may be disposed closer to the discharge port 13 than to the motor 20 in the motor portion, and more specifically, may be disposed at an upper portion of the orbiting scroll 40. The fixed scroll 50 may include fixed scroll end plate 51 formed into a circular plate shape, and the fixed wrap 52, engaged with the orbiting wrap 42 and forming a pair of compression chambers, may be formed at a lower portion of the fixed scroll end plate in a spiral shape.

A suction portion or port 53, through which refrigerant in the suction space 12 may be suctioned, may be formed on a lateral surface of the fixed scroll 50. Additionally, a discharge portion or port 54, through which compressed refrigerant may be discharged, may be disposed near a central portion of the fixed scroll end plate 51.

The orbiting wrap 42 and the fixed wrap 52 may form a plurality of compression chambers, and a volume of the compression chambers may be reduced and may compress refrigerant while the compression chambers orbit towards the discharge portion 54. Accordingly, a pressure of the compression chambers adjacent to the suction portion 53 may be minimized, and a pressure of the compression chambers communicating with the discharge portion 54 may be maximized.

A pressure of the back pressure chamber disposed between a position, where a pressure of the compression chamber is minimized, and a position, where a pressure of the compression chamber is maximized, may be an intermediate pressure having a value between a value of a suction pressure of the suction portion 53 and a value of a discharge pressure of the discharge portion 54. The intermediate pressure may be induced at a back pressure chamber 60, described hereinafter, and may form a back pressure such that the intermediate pressure presses the fixed scroll 50 towards the orbiting scroll 40. Accordingly, a scroll-side back pressure hole 51*a*, communicating with one of the areas having the intermediate pressure, may be disposed at the fixed scroll end plate 51, and the scroll-side back pressure hole 51*a* may communicate with a plate-side back pressure hole 61*a*, described hereinafter. A plurality of scroll-sided back pressure holes 51*a* may be provided.

A back pressure plate 61 forming the back pressure chamber 60 may be disposed at a top of the fixed scroll end plate 51. The back pressure plate 61 may have an approximate ring shape, and may include a support plate 62, a center of which contacts the fixed scroll end plate 51. The support plate 62 may be a ring-shaped plate, a center of which is hollow, and a plurality of plate-sided back pressure holes 61*a* independently and respectively communicating with the plurality of scroll-side back pressure holes 51*a* may pass through the support plate 62 in an shaft or axial direction.

Additionally, first and second ring-shaped walls 63, 64 may be disposed on an upper surface of the support plate 62 to surround an inner circumferential surface and an outer circumferential surface of the support plate 62. An outer circumferential surface of the first ring-shaped wall 63 and an inner circumferential surface of the second ring-shaped wall 64, and an upper surface of the support plate 62 may form the back pressure chamber 60, a ring-shaped back pressure space, along with a floating plate 65, described hereinafter.

The floating plate 65 forming the upper surface of the back pressure chamber may be disposed at an upper side of the back pressure chamber 60. Additionally, a sealing end 66 may be disposed at an upper end of a space inside of the floating plate 65. The sealing end 66 may protrude upwards from a surface of the floating plate 65. When the sealing end 66 needs to seal a discharge space 14 such that high-pressure discharged refrigerant does not leak to the suction space 12 but is discharged only to the discharge space 14, the sealing end 66 may contact a lower surface of high/low pressure separating plate 15 to seal the discharge space 14.

The above-described scroll compressor according to an embodiment may operate as follows.

When power is supplied to the stator 21, the drive shaft 25 may rotate along with the rotor 23. The orbiting scroll 40 coupled to an upper end of the rotor 23 may make an orbital movement with respect to the fixed scroll 50. Thus, a pair of compression chambers may be formed between the orbiting wrap 42 and the fixed wrap 52. A volume of the pair of compression chambers may be reduced while the pair of compression chambers moves respectively from an outer side towards an inner side, to suction, compress, and discharge refrigerant in the compression chambers.

In this case, some of the refrigerant, moving along a trace of the compression chamber, may move to the back pressure chamber 60 through the scroll-side back pressure hole 51*a* and the plate-side back pressure hole 61*a*, before reaching the discharge portion 54. Accordingly, the back pressure chamber 60 formed by the back pressure plate 61 and the floating plate 65 may form an intermediate pressure.

The floating plate 65 may be pressurized upwards by the intermediate-pressure refrigerant and may move towards the high/low pressure separating plate 15. In this case, the floating plate 65 moves into close contact with the high/low pressure separating plate 15, the discharge space 14 and the suction space 12 of the casing 10 may be separated, and refrigerant discharged to the discharge space 14 may be prevented from leaking to the suction space 12.

The back pressure plate 61 may be pressurized downwards and may press the fixed scroll 50 towards the orbiting scroll 40. As a result, the refrigerant compressed in the compression chamber may be prevented from leaking from between the orbiting scroll 40 and the fixed scroll 50 while the fixed scroll 50 is in close contact with the orbiting scroll 40.

The refrigerant, suctioned into the suction space 12 of the casing 10, may be compressed in the compression chamber, may pass through a check valve 67 in the discharge portion 54 disposed near the center of the fixed scroll 50, and may be discharged to the discharge space 14. The refrigerant discharged to the discharge space 14 undergo a series of steps where the refrigerant may circulate through a cooling cycle outside of the compressor and then may be suctioned into the suction space 12 through the suction port 11 again. When refrigerant is compressed in the compression chamber, in the scroll compressor according to embodiments, a repulsive force (or a gas force) caused by refrigerant gas may be generated.

Figure 4:
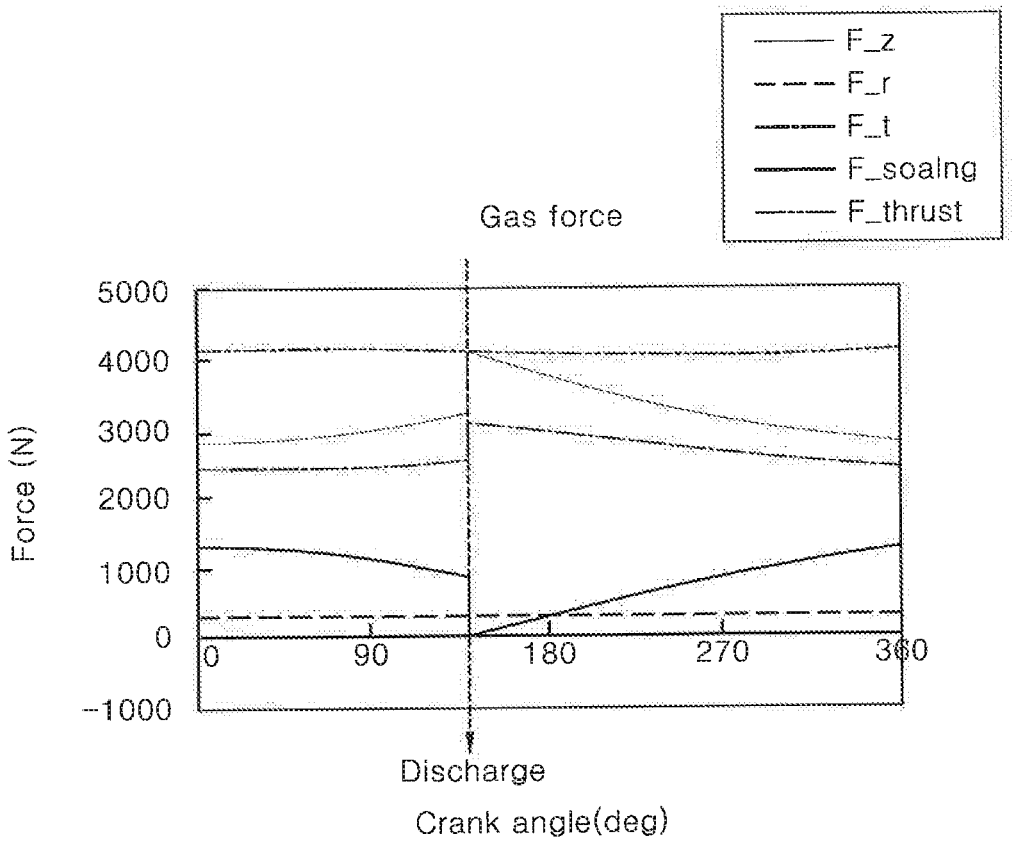
FIG. 4 is a view illustrating results of calculation of gas force based on crank angle.

FIG. 4 is a view illustrating results of calculation of gas force based on crank angle. FIG. 4 shows that while a crank angle is changed from 0 degree to 360 degrees (in other words, while the drive shaft makes one rotation), a gas force may be maximized at a certain crank angle. The angle at which the gas force is maximized may correspond to a discharge point where refrigerant compressed to a maximum level is discharged.

Figure 5:
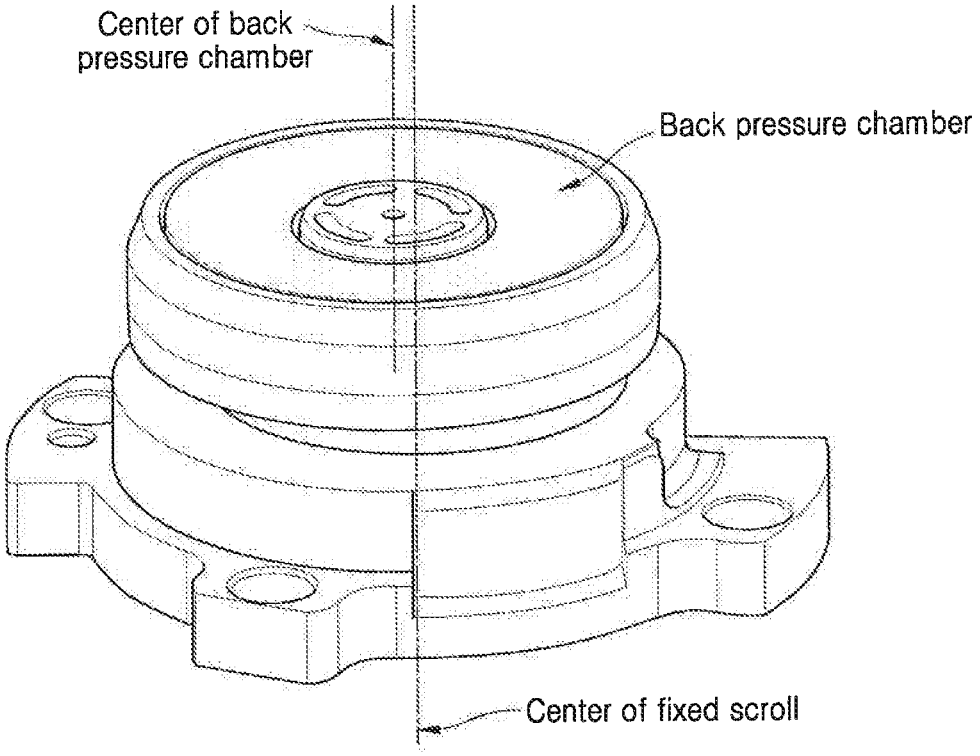
FIG. 5 is a perspective view of portions of the back pressure chamber and the fixed scroll in FIG. 3.

FIG. 5 is a perspective view of portions of the back pressure chamber 60 and the fixed scroll 50 in FIG. 3. As illustrated in FIG. 5, in the scroll compressor according to an embodiment, the center of the back pressure chamber 60 and the center of the fixed scroll 50 are eccentrically disposed (that is, the center of the back pressure chamber 60 and the center of the fixed scroll 50 are not aligned). The scroll compressor according to embodiments, which may include the back pressure chamber as in FIG. 5, may have the same advantages as those described with reference to FIG. 6.

Figure 2A:
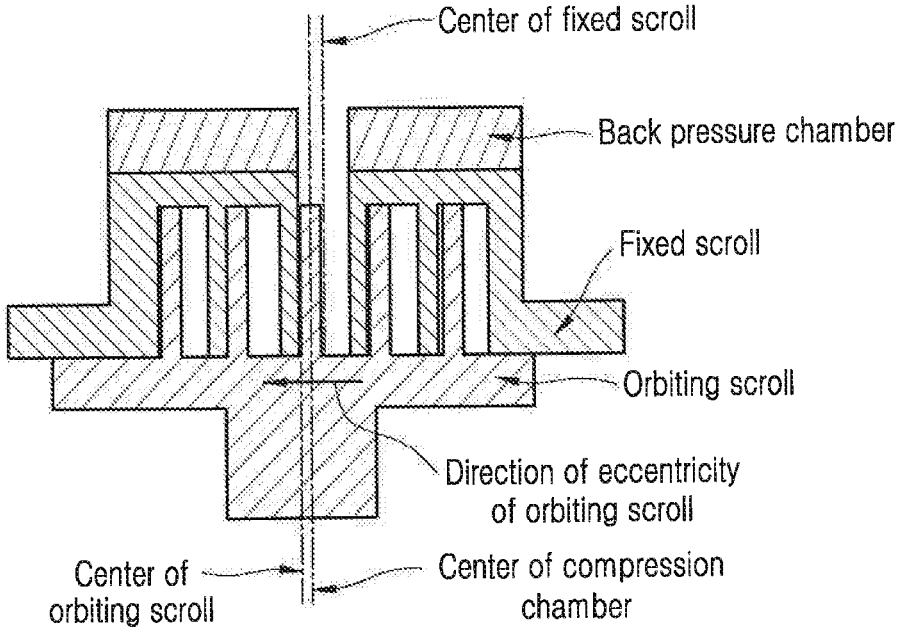
FIG. 2A RELATED ART
FIGS. 2A-2B are schematic views illustrating movement of a fixed scroll, caused by pressure of refrigerant gas in a compression chamber, when a fixed scroll and an orbiting scroll make relative orbital movements in the scroll compressor in FIG.
Figure 2B:
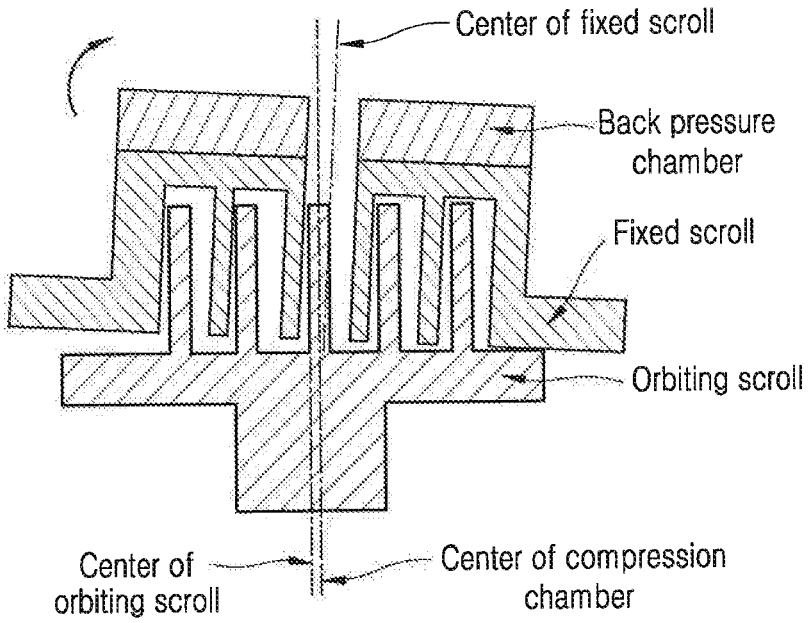
FIG. 2B RELATED ART
Figure 6:
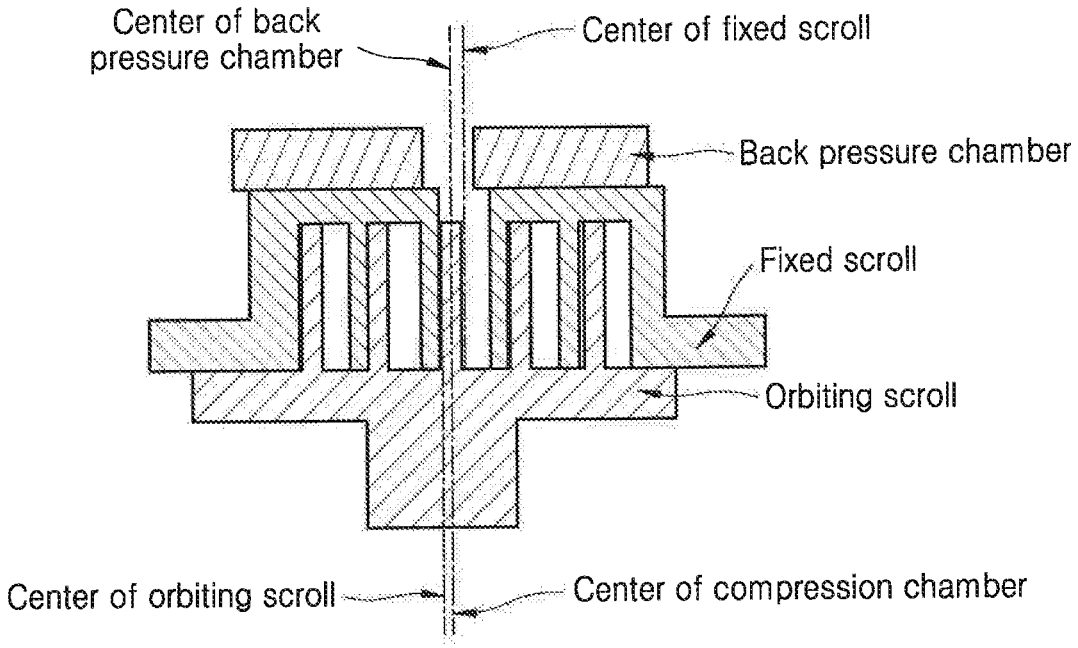
FIG. 6 is a schematic view illustrating movement of a fixed scroll, caused by pressure of refrigerant gas in a compression chamber, when a fixed scroll and an orbiting scroll make relative orbital movement in a scroll compressor according to an embodiment.

FIG. 6 is a schematic view illustrating movement of a fixed scroll, caused by pressure of refrigerant gas in a compression chamber, when a fixed scroll and an orbiting scroll make relative orbital movement in a scroll compressor according to an embodiment. Unlike the scroll compressor of the related art in FIG. 2, in the scroll compressor according to the embodiment of FIG. 6, the center of the back pressure chamber 60 is eccentrically disposed and is not aligned with the center of the fixed scroll 50.

Figure 7A:
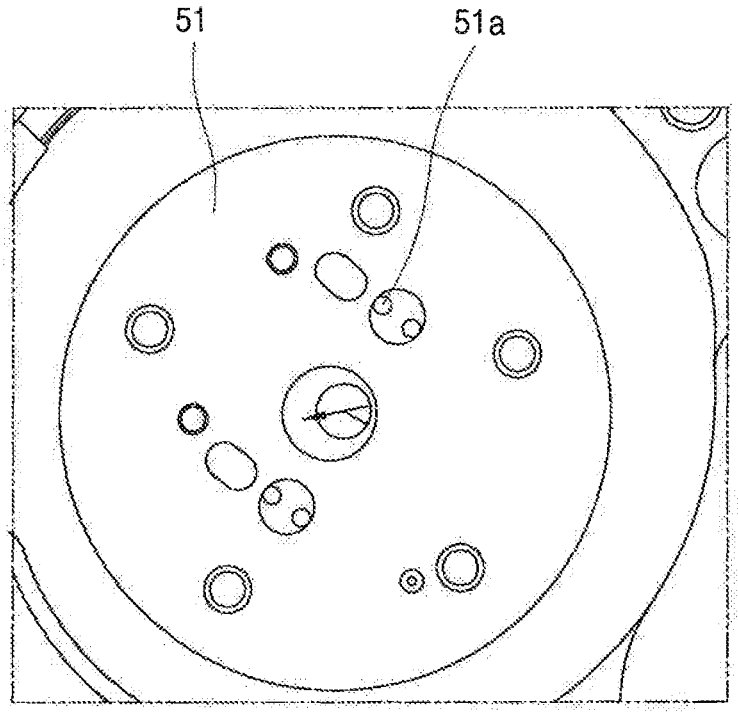
FIG. 7A is a view of a fixed scroll end plate of a fixed scroll.
Figure 7B:
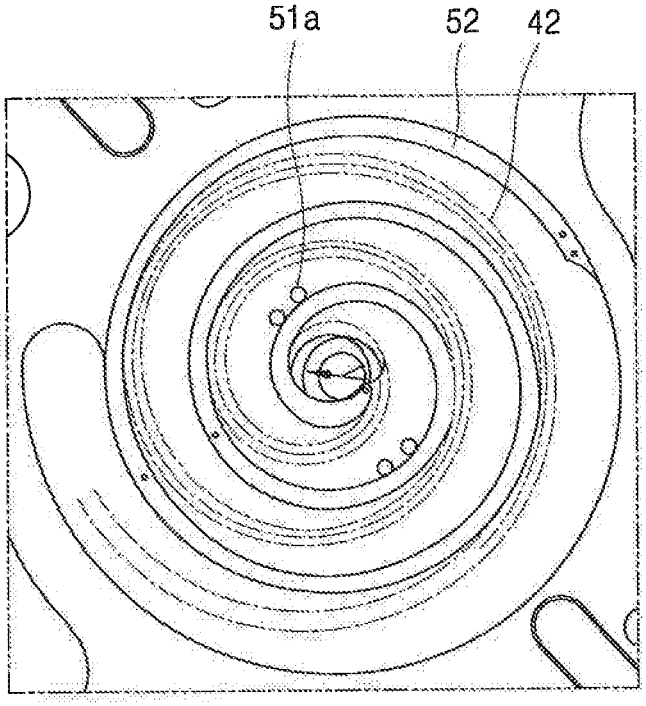
FIG. 7B is a view of an orbiting wrap and a fixed wrap in a compression chamber.
Figure 8:
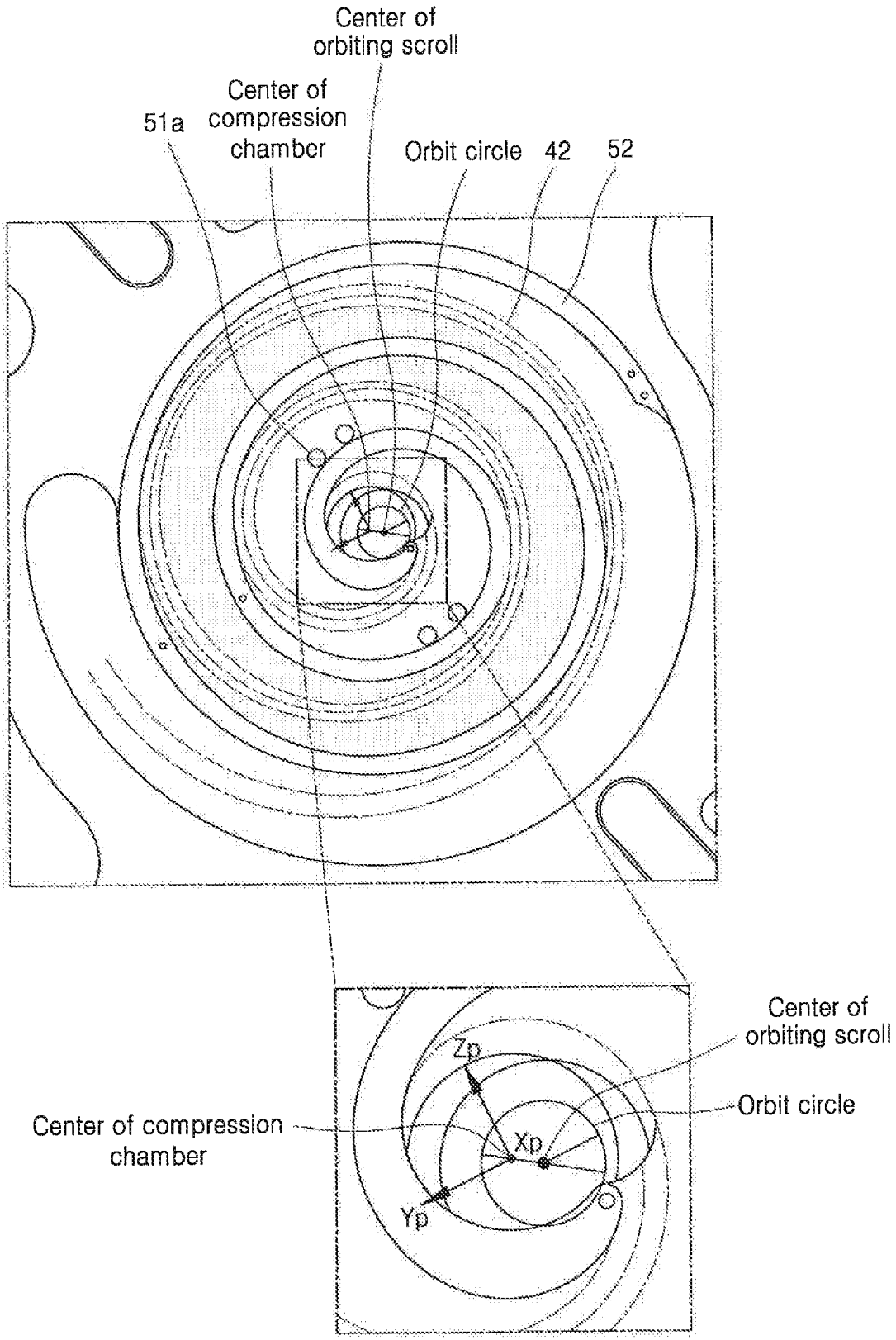
FIG. 8 is an enlarged view of FIG. 7B.

FIG. 7A is a view of the fixed scroll end plate 51 of the fixed scroll 50. FIG. 7B is a view of the orbiting wrap 42 and the fixed wrap 52 in the compression chamber. FIG. 8 is an enlarged view of FIG. 7B.

Referring to FIGS. 6 to 8, in the scroll compressor according to this embodiment, centers of the orbiting scroll 40 and the fixed scroll 50 are not aligned. As the orbiting scroll 40 continues to orbit on the basis of rotation of the drive shaft 25, the center of the orbiting scroll 40 may continue to change when the scroll compressor operates.

The orbiting scroll 40, however, may be coupled to the Oldham ring 36 to prevent self-rotation. Accordingly, a distance moved by the center of the orbiting scroll 40 may be shorter than a diameter of an orbit circle created by the Oldham ring 36.

The results of the calculations in FIG. 4 show that a value of the gas force may be maximized when refrigerant gas is discharged. Accordingly, even in the scroll compressor according to this embodiment, the center of the orbiting scroll and the center of the compression chamber are not aligned when the refrigerant gas is discharged, as in FIG. 8 (specifically, the illustration in FIG. 8).

As the fixed scroll 50 is coupled to the main frame 30, the center of the fixed scroll 50 may be fixed. The center of the orbiting scroll 40 may continue to change while the orbiting scroll makes orbital movement. However, the center of the orbiting scroll 40 at the time of discharge, where a maximum gas force is generated, may be determined according to a design of the wrap.

Although the center of the fixed scroll 50 is fixed, the center of the compression chamber may be changed to a certain degree by orbital movement of the orbiting scroll 40. However, the center of the compression chamber at the time of discharge, where a maximum gas force is generated, may have a set value according to a design of the orbiting scroll 40 and the fixed scroll 50.

In the scroll compressor according to this embodiment, as illustrated in FIG. 6, the center of the back pressure chamber 60 and the center of the compression chamber are aligned at the time of discharge where a maximum gas force is generated. In the scroll compressor based on this technical feature, the center of the back pressure chamber 60 may move to the center of the fixed scroll 50 at the time of discharge where a gas force is maximized. As a result, the intermediate pressure in the back pressure chamber 60 may effectively prevent floating of the fixed scroll 50 in the shaft direction thanks to a strong gas force of the compression chamber at the time of discharge.

In the scroll compressor according to this embodiment, an eccentric distance of the back pressure chamber 60 may be 0.25 to 0.75 times as long as a radius of an orbit circle (see FIG. 8) of the orbiting scroll 40, for example. In a case that the eccentric distance of the back pressure chamber 60 is shorter than a distance 0.25 times as long as the radius, displacement of the fixed scroll 50 may be slightly suppressed at the time of discharge. In a case that the eccentric distance of the back pressure chamber 60 is longer than a distance 0.75 times as long as the radius, a back pressure is applied to the fixed scroll 50 eccentrically in one direction when the orbiting scroll 40 orbits. Accordingly, a uniform back pressure may not be ensured, and in a worst-case scenario, refrigerant may easily leak or wear may easily occur.

Figure 9:
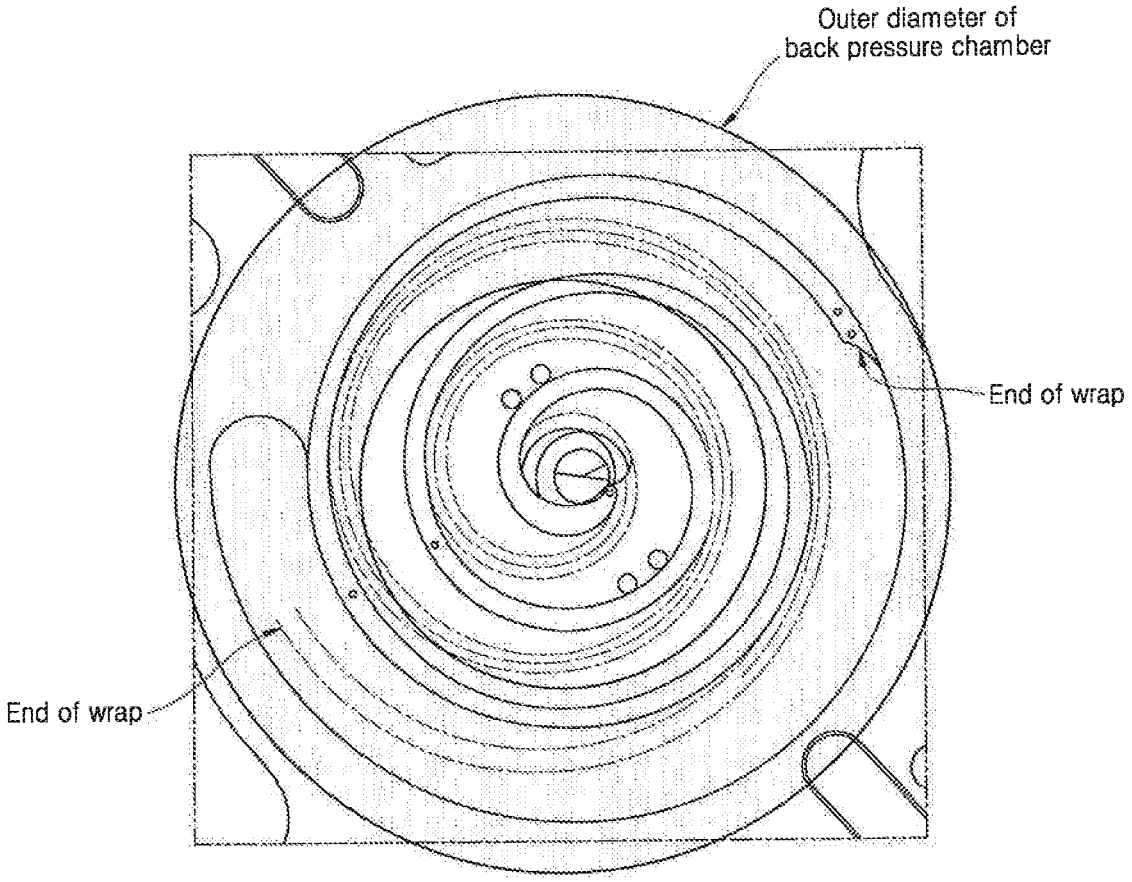
FIG. 9 is a view illustrating positions of a back pressure chamber, and an orbiting wrap and a fixed wrap according to an embodiment.
Figure 10:
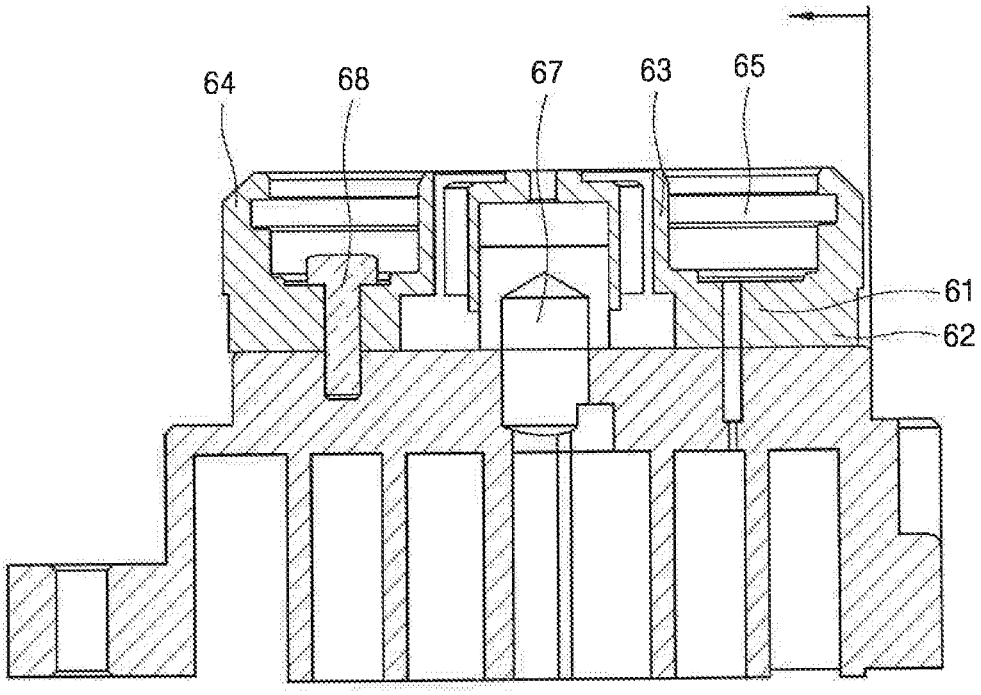
FIG. 10 is a cross-sectional view illustrating a coupling structure of a back pressure chamber according to an embodiment.

FIG. 9 is a view illustrating positions of a back pressure chamber, and an orbiting wrap and a fixed wrap according to an embodiment. FIG. 10 is a cross-sectional view illustrating a coupling structure of a back pressure chamber according to an embodiment.

As illustrated in FIG. 9, in the back pressure chamber according to an embodiment, an outer diameter of a back pressure space, where gas at the intermediate pressure is located, may be disposed further outwards than ends of the fixed wrap and the orbiting wrap in a radial direction. In a case that the back pressure space according to an embodiment is disposed further inwards than the ends of the wraps in the radial direction, a back pressure at the intermediate pressure may be applied only to a part or portion of the fixed scroll 50. Accordingly, an unbalance of the back pressure applied to the fixed scroll 50 may lead to an unbalance of a distance between the fixed scroll 50 and the orbiting scroll 40 at the time of compression. Thus, uniform compression may not be ensured, and refrigerant may locally leak due to local friction and wear.

As indicated by the arrow in FIG. 10, in the scroll compressor according to this embodiment, the center of the back pressure chamber is eccentrically (or in a non-aligned manner) coupled with respect to the fixed scroll 50. As a non-limited example, FIG. 10 shows an example in which coupler 68 is provided between the fixed scroll 50 and the back pressure chamber 60. In FIG. 10, a bolt is provided as an example of the coupler 68; however, embodiments are not limited thereto.

Additionally, in FIG. 10, the coupler 68 passes through the back pressure plate 61 and even through the floating plate 65, however, embodiments are not limited thereto. In another example, the coupler 68 may directly connect the back pressure plate 61 and the fixed scroll 50. It is enough to dispose the coupler 68 between the fixed scroll 50 and the back pressure chamber 60, and it will be understood by one having ordinary skill that a specific coupling position may not be limited.

Embodiments disclosed herein are directed to a scroll compressor where a center of a back pressure chamber and a center of a fixed scroll may be eccentrically disposed so as not to have the same center in a back pressure structure of the scroll compressor, thereby ensuring stability in movement of an orbiting scroll, which is improved by an intermediate pressure that is applied to the fixed scroll through the back pressure chamber. Embodiments disclosed herein are also directed to a scroll compressor in which the center of the back pressure chamber may be moved to a center of a compression chamber at a point where a pressure of refrigerant gas in the compression chamber is maximized, and at the time of discharge of the refrigerant gas, the fixed scroll may be prevented from being floated by the refrigerant gases to a maximum level, thereby ensuring improvement in stability in movements of the orbiting scroll. Further, embodiments disclosed herein are directed to a scroll compressor that may ensure improved stability in movement of the orbiting scroll, thereby enhancing efficiency and reliability.

In a scroll compressor according to embodiments disclosed herein, a center of a back pressure chamber is eccentrically disposed relative to a center of a fixed scroll. As a means to implement the above-described technical features, a scroll compressor according to embodiments disclosed herein may include a casing provided with an accommodation space therein and provided with a suction port configured to suction refrigerant and a discharge port configured to discharge refrigerant, a motor accommodated in the accommodation space, a fixed scroll accommodated in the accommodation space and disposed closer to the discharge port than to the motor and an orbiting scroll disposed between the motor and the fixed scroll and engaged with the fixed scroll to form a compression chamber; and a back pressure chamber disposed between the fixed scroll and the discharge port and pressurizing the fixed scroll using intermediate-pressure refrigerant. A center of the back pressure chamber may be eccentrically disposed relative to a center of the fixed scroll.

The compressor according to embodiments disclosed herein may be a scroll compressor where the center of the back pressure chamber is the same as a center of the compression chamber at the time of discharge. In this case, a direction of eccentricity of the center of the back pressure chamber may be a direction of a center of the orbiting scroll at the time of discharge, for example.

An eccentric distance of the center of the back pressure chamber may be 0.25 to 0.75 times as long as an orbit radius of the orbiting scroll. The orbit radius of the orbiting scroll may be implemented through an embodiment that includes a main frame disposed between the orbiting scroll and the motor, and a self-rotation preventer disposed between the orbiting scroll and the main frame and configured to prevent self-rotation of the orbiting scroll. In this case, the self-rotation preventer may be an Oldham ring, for example.

In the scroll compressor according to embodiments disclosed herein, the back pressure chamber may be provided therein with a ring-shaped back pressure space where refrigerant gas having intermediate pressure are present and that an outer diameter of the ring-shaped back pressure space is disposed further outwards than ends of wraps of the orbiting scroll and the fixed scroll in a radial direction. In this case, the intermediate pressure may have a value between values of a suction pressure and a discharge pressure of the compression chamber.

The intermediate pressure of the back pressure chamber may be implemented through an embodiment where the fixed scroll includes a fixed scroll end plate having a circular plate shape, the fixed scroll end plate includes a scroll-sided back pressure hole communicating with one of areas having the intermediate pressure in the compression chamber, and the back pressure chamber includes a plate-sided back pressure hole communicating with the scroll-sided back pressure hole. In this case, a plurality of scroll-sided back pressure holes and a plurality of plate-sided back pressure holes may be provided to ensure the intermediate pressure stably.

The scroll compressor according to embodiments disclosed herein may include a coupler disposed between the fixed scroll and the back pressure chamber and configured to fix the center of the back pressure chamber to a position eccentrically disposed from the center of the fixed scroll. Various coupling means may be used as the coupler. The coupler may be bolt, for example.

The ring-shaped back pressure space may include a back pressure plate including a ring-shaped supporting plate contacting the fixed scroll end plate, first and second ring-shaped walls disposed on an upper surface of the supporting plate and configured to surround inner and outer circumferential surfaces of the supporting plate, and a floating plate disposed on an upper surface of the back pressure chamber in a shaft direction of the back pressure chamber. An outer circumferential surface of the first ring-shaped wall, an inner circumferential surface of the second ring-shaped wall, an upper surface of the supporting plate, and a lower surface of the floating plate may form the ring-shaped back pressure space.

Additionally, to divide a suction space and a discharge space, a sealing end disposed at an upper end of a space inside of the floating plate, and a high/low pressure separating plate disposed between the back pressure chamber and the discharge port may be included. The floating plate may seal the high/low pressure separating plate using the intermediate pressure.

The coupler may couple the back pressure chamber and the fixed scroll in a way that couples the fixed scroll and the back pressure plate. The coupler may couple the back pressure chamber and the fixed scroll in a way that couples the fixed scroll and the floating plate.

Discharged gas may flow through a discharge space and then through the discharge port through a check valve disposed at a central portion of the fixed scroll and communicating with a discharge portion for discharging refrigerant gases, to be discharged.

According to embodiments disclosed herein, the center of the back pressure chamber may be eccentrically disposed relative to the center of the fixed scroll, thereby minimizing displacement of the fixed scroll caused by a gas force that is applied to the fixed scroll at the time of discharge. As a result, refrigerant gas between the fixed scroll and the orbiting scroll may be prevented from leaking, and a uniform back pressure may result in stability in movement of the orbiting scroll. The ensured stability in movement of the orbiting scroll may lead to an improvement in compression efficiency, and reliability of the compressor.

According to embodiments disclosed herein, in the back pressure chamber of the scroll compressor, an outer diameter of the back pressure space, where gas at an intermediate pressure is located, may be disposed further outwards than ends of the fixed wrap and the orbiting wrap in a radial direction, thereby making it possible to apply a back pressure evenly to the fixed scroll when the scroll compressor operates. Thus, the scroll compressor according to embodiments may ensure a uniform back pressure of the fixed scroll at the time of compression as well as discharge, may ensure improvement in compression efficiency, and may prevent leakage of refrigerant gas.

Embodiments have been described with reference to embodiments illustrated in the drawings. However, the embodiments are provided as examples. Additionally, various modifications and other equivalents may be made by one having ordinary skill in the art to which the embodiments pertain. Thus, the subject matter should be defined only according to the appended claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present.

As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing having an accommodation space therein, a suction port configured to suction refrigerant into the accommodation space, and a discharge port configured to discharge refrigerant from the accommodation space;

a motor accommodated in the accommodation space;

a fixed scroll accommodated in the accommodation space and disposed closer to the discharge port than to the motor;

an orbiting scroll disposed between the motor and the fixed scroll and engaged with the fixed scroll to form a compression chamber; and a back pressure chamber disposed between the fixed scroll and the discharge port and pressurizing the fixed scroll using intermediate-pressure refrigerant, wherein a center of the back pressure chamber is eccentrically disposed relative to a center of the fixed scroll.

2. The scroll compressor of claim 1, wherein the center of the back pressure chamber is the same as a center of the compression chamber at a time of discharge.

3. The scroll compressor of claim 1, wherein the center of the back pressure chamber is disposed eccentrically towards a center of the orbiting scroll at a time of discharge.

4. The scroll compressor of claim 3, wherein an eccentric distance of the center of the back pressure chamber with respect to the center of the orbiting scroll at the time of discharge is 0.25 to 0.75 times an orbit radius of the orbiting scroll.

5. The scroll compressor of claim 3, further comprising:

a main frame disposed between the orbiting scroll and the motor; and a self-rotation preventer disposed between the orbiting scroll and the main frame and configured to prevent self-rotation of the orbiting scroll.

6. The scroll compressor of claim 1, wherein the back pressure chamber is provided therein with a back pressure space having a ring shape and configured to accommodate refrigerant having the intermediate pressure.

7. The scroll compressor of claim 6, wherein an outer diameter of the back pressure space is disposed further outward than ends of wraps of the orbiting scroll and the fixed scroll in a radial direction.

8. The scroll compressor of claim 1, wherein the intermediate pressure has a value between values of a suction pressure and a discharge pressure of the compression chamber.

9. The scroll compressor of claim 1, further comprising a coupler disposed between the fixed scroll and the back pressure chamber and configured to fix the center of the back pressure chamber at a position eccentrically located from the center of the fixed scroll.

10. The scroll compressor of claim 9, wherein the coupler comprises a bolt.

11. The scroll compressor of claim 9, wherein the fixed scroll comprises a fixed scroll end plate having a circular plate shape, the fixed scroll end plate comprises at least one scroll-side back pressure hole configured to communicate with an area in the compression chamber having the intermediate pressure, and the back pressure chamber comprises at least one plate-side back pressure hole configured to communicate with the at least one scroll-side back pressure hole.

12. The scroll compressor of claim 11, wherein the at least one scroll-side back pressure hole and the at least one plate-side back pressure hole comprise a plurality of scroll-side back pressure holes and a plurality of plate-side back pressure holes.

13. The scroll compressor of claim 11, wherein the back pressure chamber comprises a back pressure plate including a support plate having a ring shape and configured to contact the fixed scroll end plate, and wherein the at least one plate-side back pressure hole is configured to pass through the support plate in an axial direction.

14. The scroll compressor of claim 13, wherein the back pressure chamber comprises first and second ring-shaped walls disposed on an upper surface of the support plate and configured to surround an inner circumferential surface and an outer circumferential surface of the support plate, and a floating plate disposed at an upper surface of the back pressure chamber in an axial direction of the back pressure chamber, and wherein an outer circumferential surface of the first ring-shaped wall and an inner circumferential surface of the second ring-shaped wall, an upper surface of the support plate, and a lower surface of the floating plate form a ring-shaped back pressure space.

15. The scroll compressor of claim 14, wherein the back pressure chamber comprises a sealing end disposed at an upper end of a space inside of the floating plate.

16. The scroll compressor of claim 14, further comprising a high/low pressure separating plate disposed between the back pressure chamber and the discharge port.

17. The scroll compressor of claim 14, wherein the coupler couples the fixed scroll and the back pressure plate.

18. The scroll compressor of claim 14, wherein the coupler couples the fixed scroll and the floating plate.

19. A scroll compressor, comprising:

a casing having an accommodation space therein, a suction port configured to suction refrigerant into the accommodation space, and a discharge port configured to discharge refrigerant from the accommodation space;

a motor accommodated in the accommodation space;

a first scroll accommodated in the accommodation space and disposed closer to the discharge port than to the motor;

a second scroll disposed between the motor and the first scroll and engaged with the first scroll to form a compression chamber; and a back pressure chamber disposed between the first scroll and the discharge port and pressurizing the first scroll using intermediate-pressure refrigerant, wherein a center of the back pressure chamber is eccentrically disposed relative to a center of the first scroll, and wherein the center of the back pressure chamber is the same as a center of the compression chamber at a time of discharge.

20. A scroll compressor, comprising:

a casing having an accommodation space therein, a suction port configured to suction refrigerant into the accommodation space, and a discharge port configured to discharge refrigerant from the accommodation space;

a motor accommodated in the accommodation space;

a first scroll accommodated in the accommodation space and disposed closer to the discharge port than to the motor;

a second scroll disposed between the motor and the first scroll and engaged with the first scroll to form a compression chamber; and a back pressure chamber disposed between the first scroll and the discharge port and pressurizing the fixed scroll using intermediate-pressure refrigerant, wherein a center of the back pressure chamber is eccentrically disposed relative to a center of the fixed scroll, wherein the center of the back pressure chamber is disposed eccentrically towards a center of the second scroll at a time of discharge, and wherein an eccentric distance of the center of the back pressure chamber with respect to the center of the second scroll at the time of discharge is 0.25 to 0.75 times an orbit radius of the second scroll.

* * * * *